US006719609B2

(12) United States Patent
Mizuno et al.

(10) Patent No.: US 6,719,609 B2
(45) Date of Patent: Apr. 13, 2004

(54) EYEGLASS LENS PROCESSING APPARATUS

(75) Inventors: Toshiaki Mizuno, Aichi (JP); Shinji Koike, Aichi (JP)

(73) Assignee: Nidek Co., Ltd., Aichi (JP)

( * ) Notice: Subject to any disclaimer, the term of this patent is extended or adjusted under 35 U.S.C. 154(b) by 104 days.

(21) Appl. No.: 09/842,642

(22) Filed: Apr. 27, 2001

(65) Prior Publication Data

US 2002/0022436 A1 Feb. 21, 2002

(30) Foreign Application Priority Data

Apr. 28, 2000 (JP) ..... P2000-134335

(51) Int. Cl.[7] ..... B24B 49/16
(52) U.S. Cl. ..... 451/10; 451/43; 451/5
(58) Field of Search ..... 451/43, 44, 10, 451/5, 255, 256, 11, 14

(56) References Cited

U.S. PATENT DOCUMENTS

| | | | | |
|---|---|---|---|---|
| 3,962,619 A | * | 6/1976 | Nishimura et al. | 318/571 |
| 4,478,009 A | * | 10/1984 | Rukavina et al. | 451/14 |
| 5,138,770 A | | 8/1992 | Matsuyama | 33/28 |
| 5,228,242 A | | 7/1993 | Matsuyama | 51/165.74 |
| 5,333,412 A | | 8/1994 | Matsuyama | 51/165.71 |
| 5,538,463 A | * | 7/1996 | Hasegawa et al. | 451/254 |
| RE35,898 E | | 9/1998 | Shibata et al. | 451/5 |
| 6,050,877 A | | 4/2000 | Shibata et al. | 451/5 |
| 6,062,947 A | | 5/2000 | Obayashi et al. | 451/5 |
| 6,120,347 A | * | 9/2000 | Sandhu et al. | 451/5 |
| 6,123,604 A | | 9/2000 | Mizuno et al. | 451/42 |
| 6,261,150 B1 | | 7/2001 | Mizuno et al. | |
| 6,478,657 B1 | * | 11/2002 | Shibata | 451/5 |

FOREIGN PATENT DOCUMENTS

| | | | |
|---|---|---|---|
| EP | 1 066 918 A2 | 1/2001 | B24B/9/14 |
| JP | 3-20603 | 1/1991 | G01B/5/06 |
| JP | 403277458 | * 12/1991 | 451/43 |
| JP | 7-44440 | 10/1995 | B24B/9/14 |
| JP | 2771547 | 4/1998 | B24B/9/14 |

* cited by examiner

*Primary Examiner*—Robert A. Rose
(74) *Attorney, Agent, or Firm*—Sughrue Mion, PLLC

(57) ABSTRACT

An eyeglass lens processing apparatus for processing a periphery of an eyeglass lens, includes: a lens rotating shaft which holds and rotates an eyeglass lens to be processed; an abrasive wheel rotating shaft movable between a retracted position and a processing position; a chamfering abrasive wheel which is attached to the abrasive wheel rotating shaft and which chamfers the lens while receiving a processing load from the lens during processing; a detecting unit which detects the load to the chamfering abrasive wheel; and a control unit which issues a control signal for relatively moving the lens and the chamfering abrasive wheel one from another to reduce the processing load if the detected processing load is higher than a predetermined first level and for continuing the chamfering, and which issues a control signal for ending the chamfering if the detected processing load over the entire periphery of the lens is lower than a predetermined second level.

4 Claims, 15 Drawing Sheets

EYEGLASS LENS PROCESSING APPARATUS

BACKGROUND OF THE INVENTION

The present invention relates to an eyeglass lens processing apparatus for processing a periphery (an edge) of an eyeglass lens.

An eyeglass lens processing apparatus is available, which has a chamfering abrasive wheel for chamfering a lens corner portion after the lens periphery is subjected to processing with a rough abrasive wheel and a finishing abrasive wheel. An eyeglass lens processing apparatus having a grooving abrasive wheel is also proposed.

In case of processing a lens narrow in vertical width, such as a half-eye lens, the related eyeglass lens processing apparatus does not execute processing if an abrasive wheel interferes with a lens holding member during chamfering process, or only executes limited chamfering to such a degree as to avoid the interference. For this reason, the related eyeglass lens processing apparatus suffers from a problem in that a minimal processing diameter of a lens, which can be subjected to chamfering process, is large.

The related eyeglass lens processing apparatus controls an amount of chamfering by adjusting the number of rotation of the lens, and thus there are some cases that processing efficiency is not good.

SUMMARY OF THE INVENTION

Accordingly, an object of the present invention is to provide an eyeglass lens processing apparatus, which can efficiently execute chamfering process and which can make a minimal processing diameter of a lens as small as possible.

The present invention provides the followings:

(1) An eyeglass lens processing apparatus for processing a periphery of an eyeglass lens, comprising:
- a lens rotating shaft which holds and rotates an eyeglass lens to be processed;
- an abrasive wheel rotating shaft movable between a retracted position and a processing position;
- a chamfering abrasive wheel which is attached to the abrasive wheel rotating shaft and which chamfers the lens while receiving a processing load from the lens during processing;
- a detecting unit which detects the load to the chamfering abrasive wheel; and
- a control unit which issues a control signal for relatively moving the lens and the chamfering abrasive wheel one from another to reduce the processing load if the detected processing load is higher than a predetermined first level and for continuing the chamfering, and which issues a control signal for ending the chamfering if the detected processing load over the entire periphery of the lens is lower than a predetermined second level.

(2) The eyeglass lens processing apparatus according to (1), wherein the control unit issues a control signal for ending the chamfering if a predetermined time period is elapsed or the lens is rotated predetermined number of times even in a case where the detected processing load over the entire periphery of the lens is not lower than the predetermined second level.

(3) The eyeglass lens processing apparatus according to (1), wherein the lens rotating shaft includes a first shaft having a cup holder to which a cup attached to the lens is to be attached, and a second shaft having a lens retainer to which a rubber member for abutting against the lens is fixed, and the first and second shafts are relatively moved one from another in a direction of a rotational axis thereof to clamp the lens therebetween.

(4) The eyeglass lens processing apparatus according to (1), further comprising:
- a first moving unit having a motor, which relatively moves the lens rotating shaft and the abrasive wheel rotating shaft one from another to vary an axis-to-axis distance therebetween;
- a second moving unit having a motor, which relatively moves the lens rotating shaft and the abrasive wheel rotating shaft one from another in a direction of a rotational axis thereof; and
- wherein the control unit issues the control signal to at least one of the first and second moving unit to relatively move the lens and the chamfering abrasive wheel the one from the other.

(5) The eyeglass lens processing apparatus according to (1), further comprising:
- a first rotating unit having a first motor, which rotates the lens wheel rotating shaft;
- a second rotating unit having a second motor, which rotates the abrasive wheel rotating shaft; and
- wherein the detecting unit detects a load electric current of at least one of the first and second motors.

(6) The eyeglass lens processing apparatus according to (5), wherein the predetermined second level includes an electric current value not higher than the predetermined first level.

(7) An eyeglass lens processing apparatus for processing a periphery of an eyeglass lens, comprising:
- a lens rotating shaft which holds and rotates an eyeglass lens to be processed;
- an abrasive wheel rotating shaft movable between a retracted position and a processing position;
- a chamfering abrasive wheel which is attached to the abrasive wheel rotating shaft and which chamfers the lens while receiving a processing load from the lens during processing;
- a detecting unit which detects the load to the chamfering abrasive wheel; and
- a control unit which issues a control signal for relatively moving the lens and the chamfering abrasive wheel one from another to reduce the processing load if the detected processing load is higher than a predetermined first level and for continuing the chamfering, and which issues a control signal for ending the chamfering if the detected processing load over the entire periphery of the lens is lower than a predetermined second level,
- wherein the control unit issues a control signal for ending the chamfering if a predetermined time period is elapsed or the lens is rotated predetermined number of times even in a case where the detected processing load over the entire periphery of the lens is not lower than the predetermined second level.

The present disclosure relates to the subject matter contained in Japanese patent application No. 2000-134335 (filed on Apr. 28, 2000), which is expressly incorporated herein by reference in its entirety.

DESCRIPTION OF THE PREFERRED EMBODIMENT

Hereafter, a description will be given of an embodiment of the invention.

(1) Overall Construction

Figure 1:
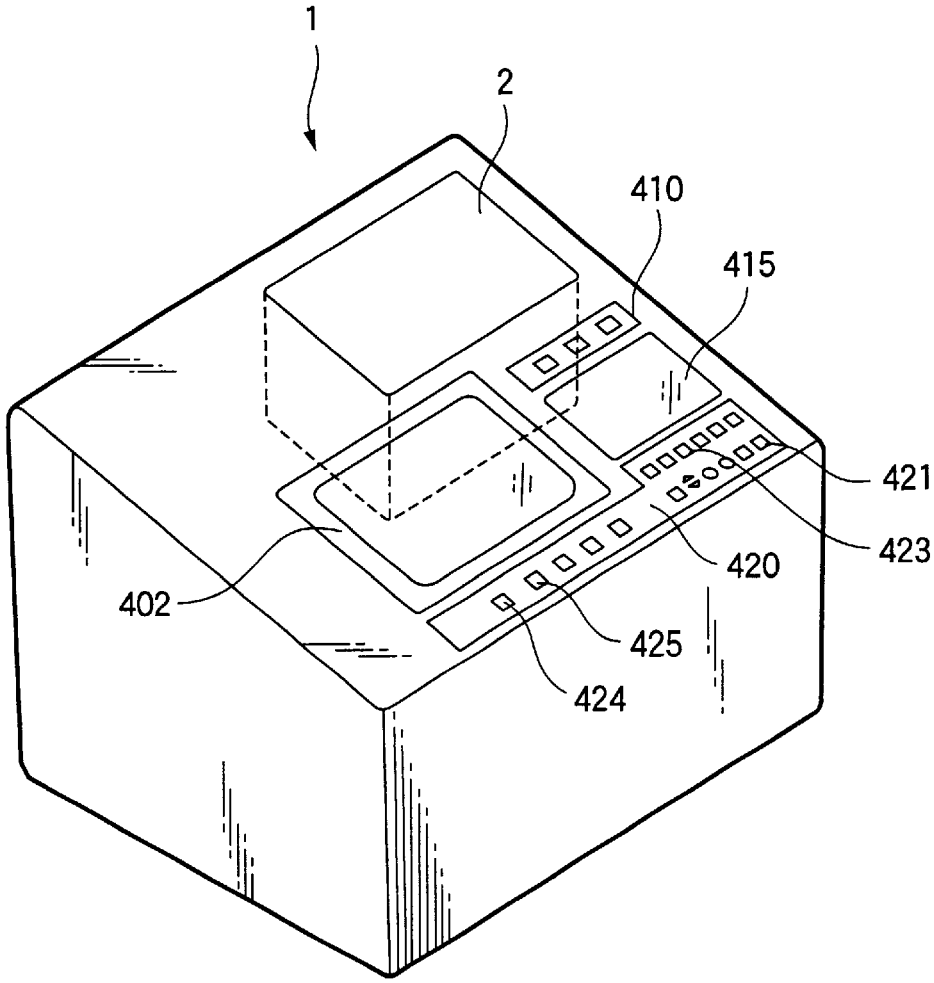
FIG. 1 is a diagram illustrating the external configuration of an eyeglass-lens processing apparatus in accordance with the invention.

FIG. 1 is a diagram illustrating the external configuration of an eyeglass-lens processing apparatus in accordance with the invention. An eyeglass-frame-shape measuring device 2 is incorporated in an upper right-hand rear portion of a main body 1 of the apparatus. As the frame-shape measuring device 2, ones that disclosed in U.S. Pat. Nos. 5,228,242, 5,333,412, 5,347,762 (Re. Pat. No. 35,898) and so on, the assignee of which is the same as the present application, can be used. A switch panel section 410 having switches for operating the frame-shape measuring device 2 and a display 415 for displaying processing information and the like are disposed in front of the frame-shape measuring device 2. Further, reference numeral 420 denotes a switch panel section having various switches for inputting processing conditions and the like and for giving instructions for processing, and numeral 402 denotes an openable window for a processing chamber.

Figure 2:
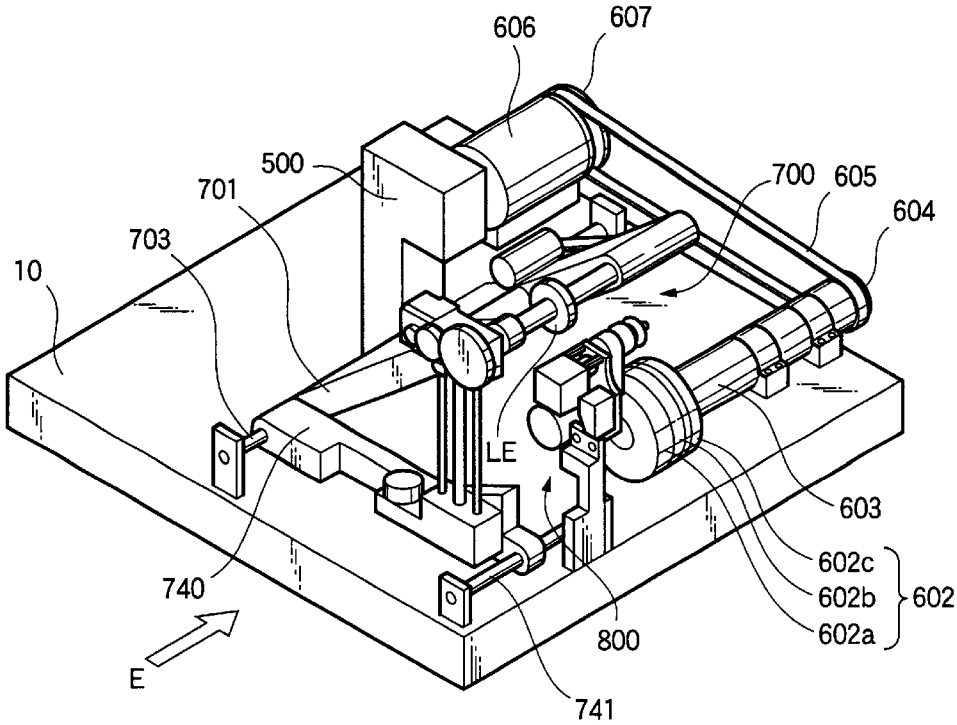
FIG. 2 is a perspective view illustrating the arrangement of a lens processing section disposed in a casing of a main body of the apparatus.

FIG. 2 is a perspective view illustrating the arrangement of a lens processing section disposed in the casing of the main body 1. A carriage section 700 is mounted on a base 10, and a subject lens LE clamped by a pair of lens chuck shafts of a carriage 701 is ground by a group of abrasive wheels 602 attached to a rotating shaft 601. The group of abrasive wheels 602 include a rough abrasive wheel 602*a* for glass lenses, a rough abrasive wheel 602*b* for plastic lenses, and a finishing abrasive wheel 602*c* for beveling processing and flat processing. The rotating shaft 601 is rotatably attached to the base 10 by a spindle 603. A pulley 604 is attached to an end of the rotating shaft 601, and is linked through a belt 605 to a pulley 607 which is attached to a rotating shaft of an abrasive-wheel rotating motor 606.

A lens-shape measuring section 500 is provided in the rear of the carriage 701. Further, a chamfering and grooving mechanism section 800 is provided in the front side.

(2) Construction of Various Sections (A) Carriage Section

Figure 3A:
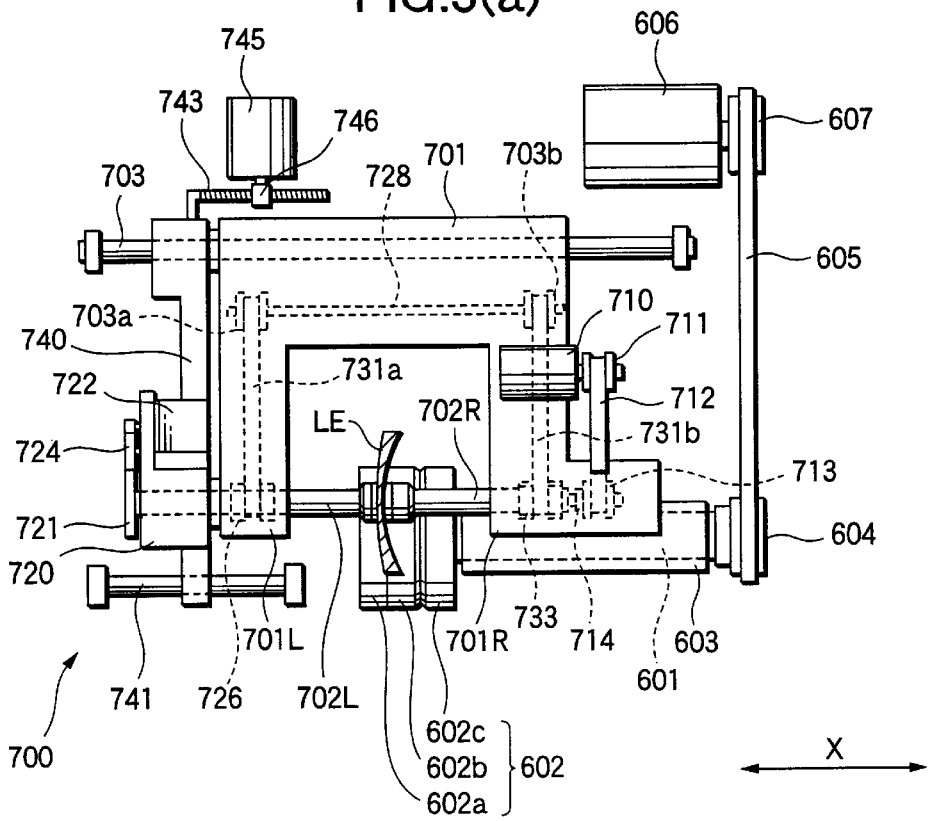
FIG. 3 is a schematic diagram of essential portions of a carriage section.
Figure 3B:
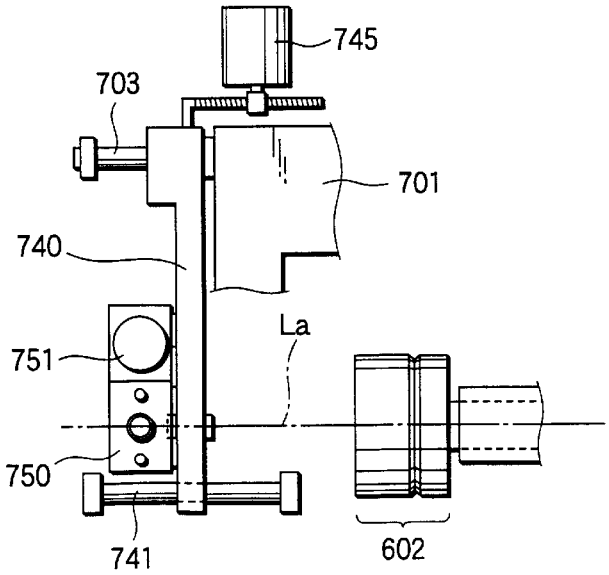
Figure 4:
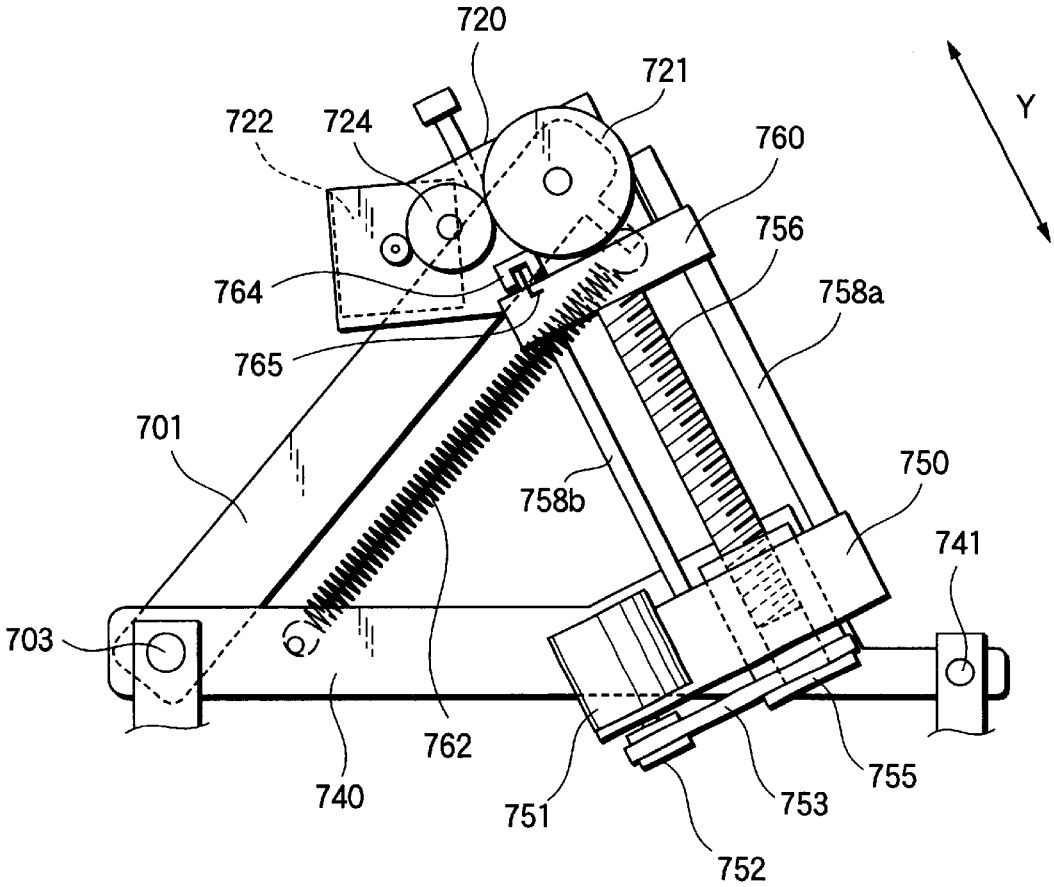
FIG. 4 is a view, taken from the direction of arrow E in FIG. 2, of the carriage section.

Referring to FIGS. 2, 3, and 4, a description will be given of the construction of the carriage section 700. FIG. 3 is a schematic diagram of essential portions of the carriage section 700, and FIG. 4 is a view, taken from the direction of arrow E in FIG. 2, of the carriage section 700.

The carriage 701 is capable of rotating the lens LE while chucking it with two lens chuck shafts (lens rotating shafts) 702L and 702R, and is rotatably slidable with respect to a carriage shaft 703 that is fixed to the base 10 and that extends in parallel to the abrasive-wheel rotating shaft 601. Hereafter, a description will be given of a lens chuck mechanism and a lens rotating mechanism as well as an X-axis moving mechanism and a Y-axis moving mechanism of the carriage 701 by assuming that the direction in which the carriage 701 is moved in parallel to the abrasive-wheel rotating shaft 601 is the X axis, and the direction for changing the axis-to-axis distance between the chuck shafts (702L, 702R) and the abrasive-wheel rotating shaft 601 by the rotation of the carriage 701 is the Y axis.

Lens Chuck Mechanism and Lens Rotating Mechanism

The chuck shaft 702L and the chuck shaft 702R are rotatably held coaxially by a left arm 701L and a right arm 701R, respectively, of the carriage 701. A chucking motor 710 is fixed to the center of the upper surface of the right arm 701R, and the rotation of a pulley 711 attached to a rotating shaft of the motor 710 rotates a feed screw 713, which is rotatably held inside the right arm 701R, by means of a belt 712. A feed nut 714 is moved in the axial direction by the rotation of the feed screw 713. As a result, the chuck shaft 702R connected to the feed nut 714 can be moved in the axial direction, so that the lens LE is clamped by the chuck shafts 702L and 702R.

A rotatable block 720 for attaching a motor, which is rotatable about the axis of the chuck shaft 702L, is attached to a left-side end portion of the left arm 701L, and the chuck shaft 702L is passed through the block 720, a gear 721 being secured to the left end of the chuck shaft 702L. A pulse motor 722 for lens rotation is fixed to the block 720, and as the motor 722 rotates the gear 721 through a gear 724, the rotation of the motor 720 is transmitted to the chuck shaft 702L. A pulley 726 is attached to the chuck shaft 702L inside the left arm 701L. The pulley 726 is linked by means of a timing belt 731*a* to a pulley 703*a* secured to a left end of a rotating shaft 728, which is held rotatably in the rear of the carriage 701. Further, a pulley 703*b* secured to a right end of the rotating shaft 728 is linked by means of a timing belt 731*b* to a pulley 733 which is attached to the chuck shaft 702R in such a manner as to be slidable in the axial direction of the chuck shaft 702R inside the right arm 701R. By virtue of this arrangement, the chuck shaft 702L and the chuck shaft 702R are rotated synchronously.

Figure 14:
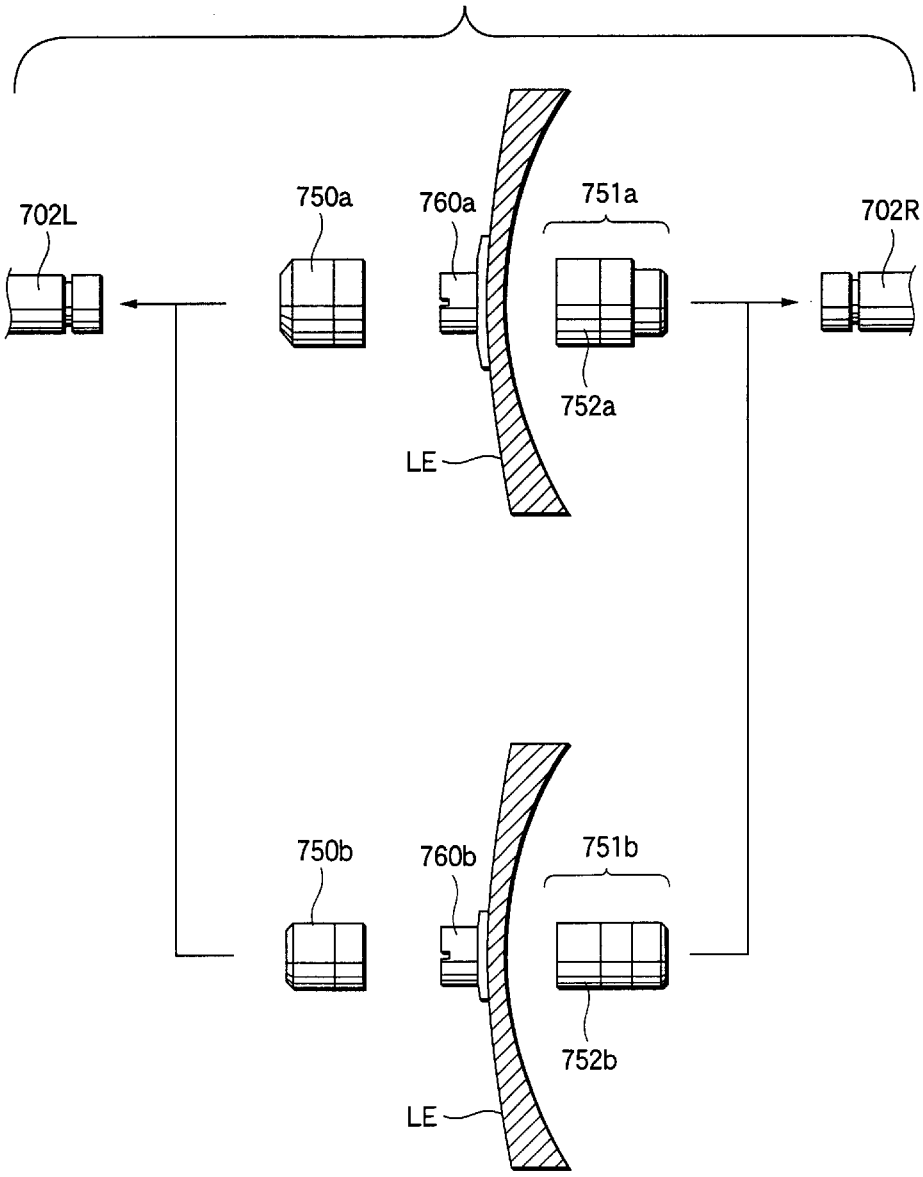
FIG. 14 is an explanatory diagram showing a lens holding member to be attached to a lens chuck shaft.

Lens holding members are attached respectively to the chuck shaft 702L and the chuck shaft 702R. As shown in FIG. 14, in case where a normal lens large in processing diameter is to be processed, a cup holder 750*a* is attached to the chuck shaft 702L, and a lens retainer 751*a* to which a rubber member 752*a* is fixed is attached to the chuck shaft 702R. Further, in order to hold the lens LE with the chuck shafts 702L and 702R, a cup 760*a* is preliminarily fixed to the lens LE.

In case where a so-called half-eye lens is to be processed (i.e. a lens narrow in vertical width is to be processed), a cup holder 750*b* smaller in diameter than the cup holder 750*a* is attached to the chuck shaft 702L, and a lens retainer 751*b* smaller in diameter than the lens retainer 751*a* is attached to the chuck shaft 702R. Similarly to the lens retainer 751*a*, a rubber member 752*b* is fixed to a leading end of the lens retainer 751*b* to be contacted with the lens LE. Further, as a cup fixed to the lens LE, a cup 760*b* smaller in diameter than the cup 760*a* is used.

X-axis Moving Mechanism and Y-axis Moving Mechanism of Carriage

The carriage shaft 703 is provided with a movable arm 740 which is slidable in its axial direction so that the arm 740 is movable in the X-axis direction (in the axial direction of the shaft 703) together with the carriage 701. Further, the arm 740 at its front portion is slidable on and along a guide shaft 741 that is secured to the base 10 in a parallel positional relation to the shaft 703. A rack 743 extending in parallel to the shaft 703 is attached to a rear portion of the arm 740, and this rack 743 meshes with a pinion 746 attached to a rotating shaft of a motor 745 for moving the carriage in the X-axis direction, the motor 745 being secured to the base 10. By virtue of the above-described arrangement, the motor 745 is able to move the carriage 701 together with the arm 740 in the axial direction of the shaft 703 (in the X-axis direction).

As shown in FIG. 3(*b*), a swingable block 750 is attached to the arm 740 in such a manner as to be rotatable about the axis La which is in alignment with the rotational center of the abrasive wheels 602. The distance from the center of the shaft 703 to the axis La and the distance from the center of the shaft 703 to the rotational center of the chuck shaft (702L, 702R) are set to be identical. A Y-axis moving motor 751 is attached to the swingable block 750, and the rotation of the motor 751 is transmitted by means of a pulley 752 and a belt 753 to a female screw 755 held rotatably in the swingable block 750. A feed screw 756 is inserted in a threaded portion of the female screw 755 in mesh therewith, and the feed screw 756 is moved vertically by the rotation of the female screw 755.

A guide block 760 which abuts against a lower end surface of the motor-attaching block 720 is fixed to an upper end of the feed screw 756, and the guide block 760 moves along two guide shafts 758*a* and 758*b* implanted on the swingable block 750. Accordingly, as the guide block 760 is vertically moved together with the feed screw 756 by the rotation of the motor 751, it is possible to change the vertical position of the block 720 abutting against the guide block 760. As a result, the vertical position of the carriage 701 attached to the block 720 can be also changed (namely, the carriage 701 rotates about the shaft 703 to change the axis-to-axis distance between the chuck shafts (702L, 702R) and the abrasive-wheel rotating shaft 601). A spring 762 is stretched between the left arm 701L and the arm 740, so that the carriage 701 is constantly urged downward to impart processing pressure onto the lens LE. Although the downward urging force acts on the carriage 701, the downward movement of the carriage 701 is restricted such that the carriage 701 can only be lowered down to the position in which the block 720 abuts against the guide block 760. A sensor 764 for detecting an end of processing is attached to the block 720, and the sensor 764 detects the end of processing (ground state) by detecting the position of a sensor plate 765 attached to the guide block 760.

(B) Lens-Shape Measuring Section

Figure 5:
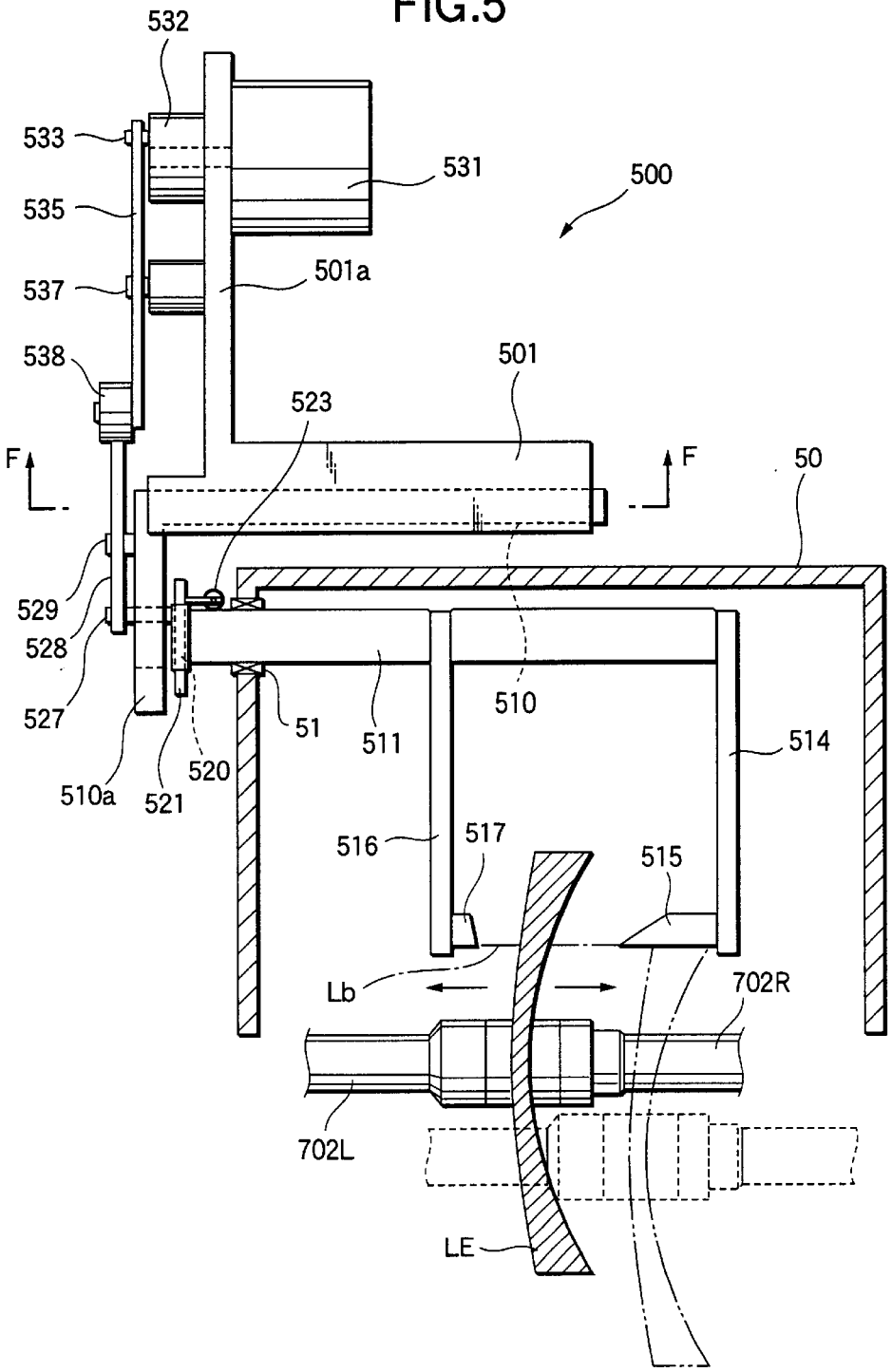
FIG. 5 is a top view of a lens-shape measuring section.
Figure 6:
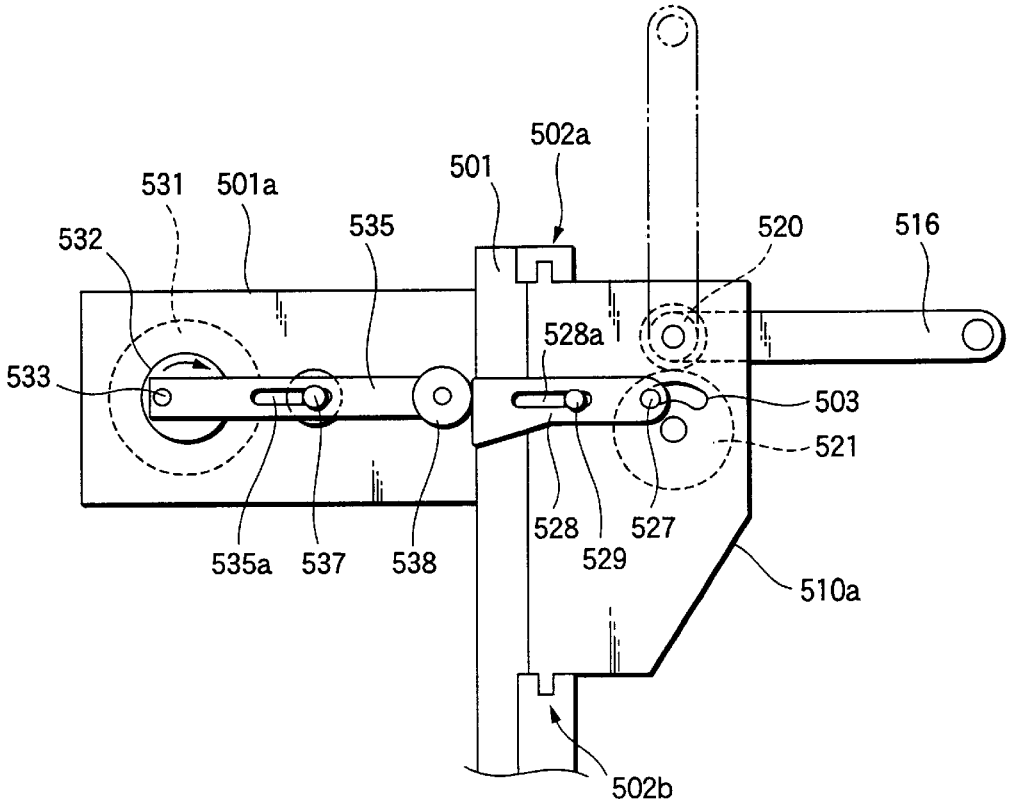
FIG. 6 is a left side elevational view of FIG. 5.
Figure 7:
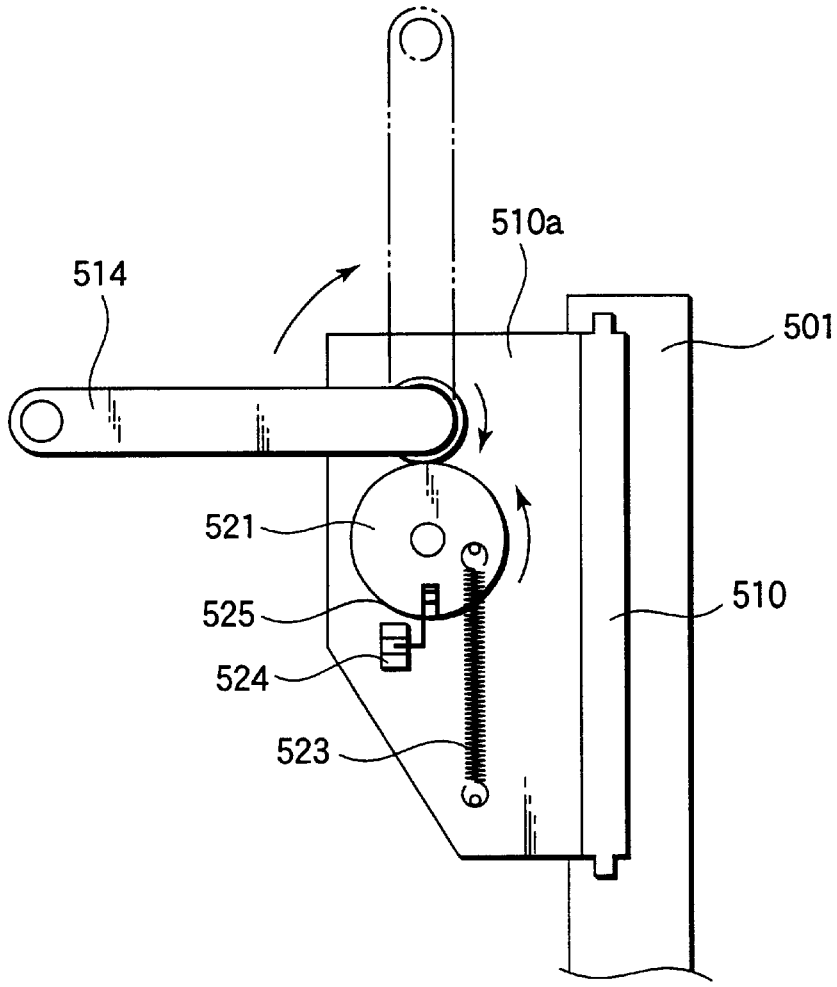
FIG. 7 is a view illustrating essential portions of the right side surface shown in FIG. 5.
Figure 8:
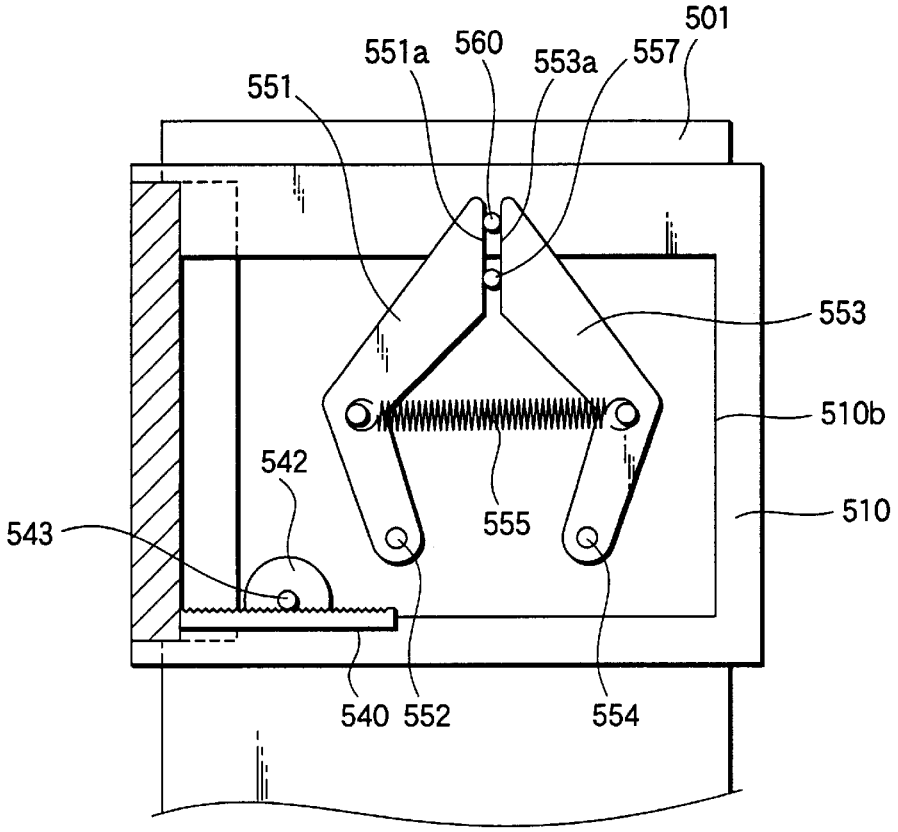
FIG. 8 is a cross-sectional view taken along line F—F in FIG. 5.

Referring to FIGS. 5 to 8, a description will be given of the construction of the lens-shape measuring section 500. FIG. 5 is a top view of the lens-shape measuring section, FIG. 6 is a left side elevational view of FIG. 5, and FIG. 7 is a view illustrating essential portions of the right side surface shown in FIG. 5. FIG. 8 is a cross-sectional view taken along line F—F in FIG. 5.

A supporting block 501 is provided uprightly on the base 10. A sliding base 510 is held on the supporting block 501 in such a manner as to be slidable in the left-and-right direction (in a direction parallel to the chuck shafts) by means of a pair of upper and lower guide rail portions 502*a* and 502*b* juxtaposed vertically. A forwardly extending side plate 510*a* is formed integrally at a left end of the sliding base 510, and a shaft 511 having a parallel positional relation to the chuck shafts 702L and 702R is rotatably attached to the side plate 510*a*. A feeler arm 514 having a feeler 515 for measuring the lens rear surface is secured to a right end portion of the shaft 511, while a feeler arm 516 having a feeler 517 for measuring the lens front surface is secured to the shaft 511 at a position close to its center. Both the feeler 515 and the feeler 517 have a hollow cylindrical shape, a distal end portion of each of the feelers is obliquely cut as shown in FIG. 5, and the obliquely cut tip comes into contact with the rear surface or front surface of the lens LE. Contact points of the feeler 515 and the feeler 517 are opposed to each other, and the interval there between is arranged to be constant. Incidentally, the axis Lb connecting the contact point of the feeler 515 and the contact point of the feeler 517 is in a predetermined parallel positional relation to the axis of the chuck shafts (702L, 702R) in the state of measurement shown in FIG. 5. Further, the feeler 515 has a slightly longer hollow cylindrical portion, and measurement is effected by causing its side surface to abut against an edge surface of the lens LE during the measurement of the outside diameter of the lens LE.

A small gear 520 is fixed to a proximal portion of the shaft 511, and a large gear 521 which is rotatably provided on the side plate 510*a* is in mesh with the small gear 520. A spring 523 is stretched between the large gear 521 and a lower portion of the side plate 510*a*, so that the large gear 521 is constantly pulled in the direction of rotating clockwise in FIG. 7 by the spring 523. Namely, the arms 514 and 516 are urged so as to rotate downward by means of the small gear 520.

A slot 503 is formed in the side plate 510*a*, and a pin 527 which is eccentrically secured to the large gear 521 is passed through the slot 503. A first moving plate 528 for rotating the large gear 521 is attached to the pin 527. An elongated hole 528*a* is formed substantially in the center of the first moving plate 528, and a fixed pin 529 secured to the side plate 510*a* is engaged in the elongated hole 528*a*.

Further, a motor 531 for arm rotation is attached to a rear plate 501*a* extending in the rear of the supporting block 501, and an eccentric pin 533 at a position eccentric from a rotating shaft of the motor 531 is attached to a rotating member 532 provided on a rotating shaft of the motor 531. A second moving plate 535 for moving the first moving plate 528 in the back-and-forth direction (in the left-and-right direction in FIG. 6) is attached to the eccentric pin 533. An elongated hole 535*a* is formed substantially in the center of the second moving plate 535, and a fixed pin 537 which is fixed to the rear plate 501*a* is engaged in the elongated hole 535*a*. A roller 538 is rotatably attached to an end portion of the second moving plate 535.

When the eccentric pin 533 is rotated clockwise from the state shown in FIG. 6 by the rotation of the motor 531, the second moving plate 535 moves forward (rightward in FIG. 6) by being guided by the fixed pin 537 and the elongated hole 535*a*. Since the roller 538 abuts against the end face of the first moving plate 528, the roller 538 moves the first moving plate 528 in the forward direction as well owing to the movement of the second moving plate 535. As a result of this movement, the first moving plate 528 rotates the large gear 521 by means of the pin 527. The rotation of the large gear 521, in turn, causes the feeler arms 514 and 516 attached to the shaft 511 to retreat to an upright state. The driving by the motor 531 to this retreated position is determined as an unillustrated micro switch detects the rotated position of the rotating member 532.

If the motor 531 is reversely rotated, the second moving plate 535 is pulled back, the large gear 521 is rotated by being pulled by the spring 523, and the feeler arms 514 and 516 are inclined toward the front side. The rotation of the large gear 521 is limited as the pin 527 comes into contact with an end surface of the slot 503 formed in the side plate 510*a*, thereby determining the measurement positions of the feeler arms 514 and 516. The rotation of the feeler arms 514 and 516 up to this measurement positions is detected as the position of a sensor plate 525 attached to the large gear 521 is detected by a sensor 524 attached to the side plate 510*a*, as shown in FIG. 7.

Figure 9A:
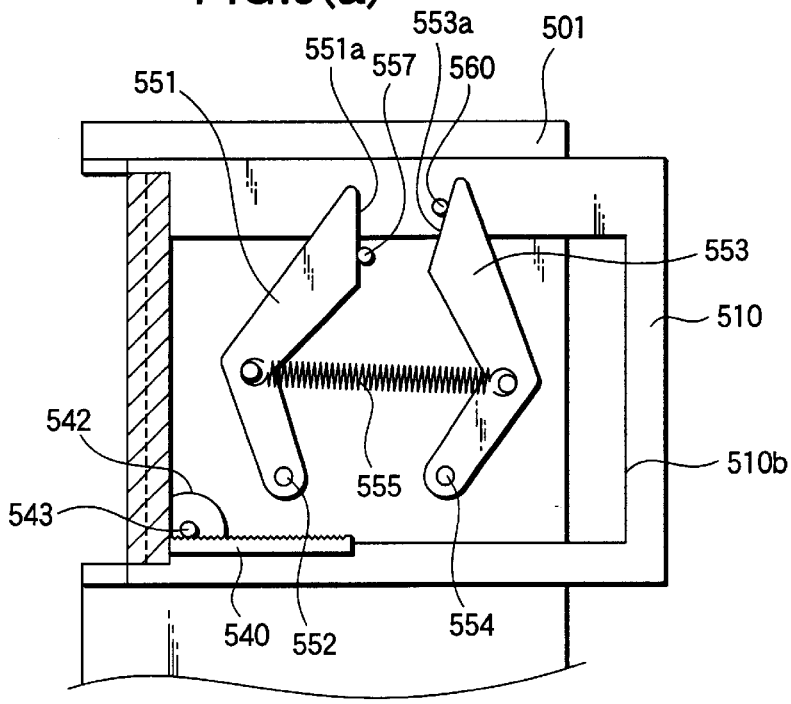
FIG. 9 is a diagram explaining the state of left-and-right movement of the lens-shape measuring section.
Figure 9B:
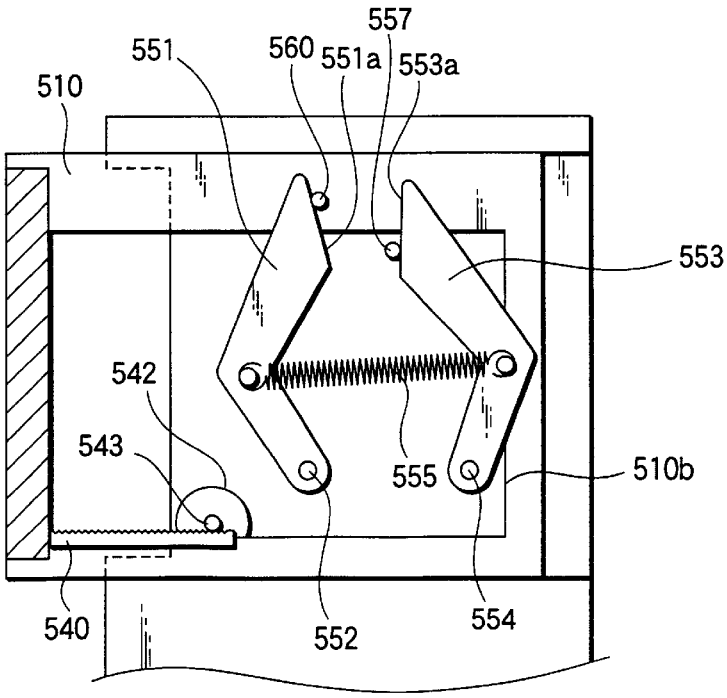

Referring to FIGS. 8 and 9, a description will be given of a left-and-right moving mechanism of the sliding base 510 (feeler arms 514, 515). FIG. 9 is a diagram illustrating the state of left-and-right movement.

An opening 510*b* is formed in the sliding base 510, and a rack 540 is provided at a lower end of the opening 510*b*. The rack 540 meshes with a pinion 543 of an encoder 542 fixed to the supporting block 501, and the encoder 542 detects the direction of the left-and-right movement and the amount of movement of the sliding base 510. A chevron-shaped driving plate 551 and an inverse chevron-shaped driving plate 553 are attached to a wall surface of the supporting block 501, which is exposed through the opening 510*b* in the sliding base 510, in such a manner as to be rotatable about a shaft 552 and a shaft 554, respectively. A spring 555 having urging forces in the directions in which the driving plate 551 and the driving plate 553 approach each other is stretched between the two driving plates 551 and 553. Further, a limiting pin 557 is embedded in the wall surface of the supporting block 501, and when an external force is not acting upon the sliding base 510, both an upper end face 551*a* of the driving plate 551 and an upper end face 553*a* of the driving plate 553 are in a state of abutting against the limiting pin 557, and this limiting pin 557 serves as an origin of the left- and rightward movement.

Meanwhile, a guide pin 560 is secured to an upper portion of the sliding base 510 at a position between the upper end face 551*a* of the driving plate 551 and the upper end face 553*a* of the driving plate 553. When a rightwardly moving force acts upon the sliding base 510, as shown in FIG. 9(*a*), the guide pin 560 abuts against the upper end face 553*a* of the driving plate 553, causing the driving plate 553 to be tilted rightward. At this time, since the driving plate 551 is fixed by the limiting pin 557, the sliding base 510 is urged in the direction of being returned to the origin of left- and rightward movement (in the leftward direction) by the spring 555. On the other hand, when a leftwardly moving force acts upon the sliding base 510, as shown in FIG. 9(*b*), the guide pin 560 abuts against the upper end face 551*a* of the driving plate 551, and the driving plate 551 is tilted leftward, but the driving plate 553 is fixed by the limiting pin 557. Accordingly, the sliding base 510 this time is urged in the direction of being returned to the origin of left- and rightward movement (in the rightward direction) by the spring 555. From such movement of the sliding base 510, the amount of movement of the feeler 515 in contact with the lens rear surface and the feeler 517 in contact with the lens front surface (the amount of axial movement of the chuck shafts) is detected by a single encoder 542.

It should be noted that, in FIG. 5, reference numeral 50 denotes a waterproof cover, and only the shaft 511, the feeler arms 514 and 516, and the feelers 515 and 517 are exposed in the waterproof cover 50. Numeral 51 denotes a sealant for sealing the gap between the waterproof cover 50 and the shaft 511. Although a coolant is jetted out from an unillustrated nozzle during processing, since the lens-shape measuring section 500 is disposed in the rear of the processing chamber and by virtue of the above-described arrangement, it is possible to provide waterproofing for the electrical components and moving mechanism of the lens-shape measuring section 500 by merely providing shielding for the shaft 511 exposed in the waterproof cover 50, and the waterproofing structure is thus simplified.

(C) Chamfering and Grooving Mechanism Section

Figure 10:
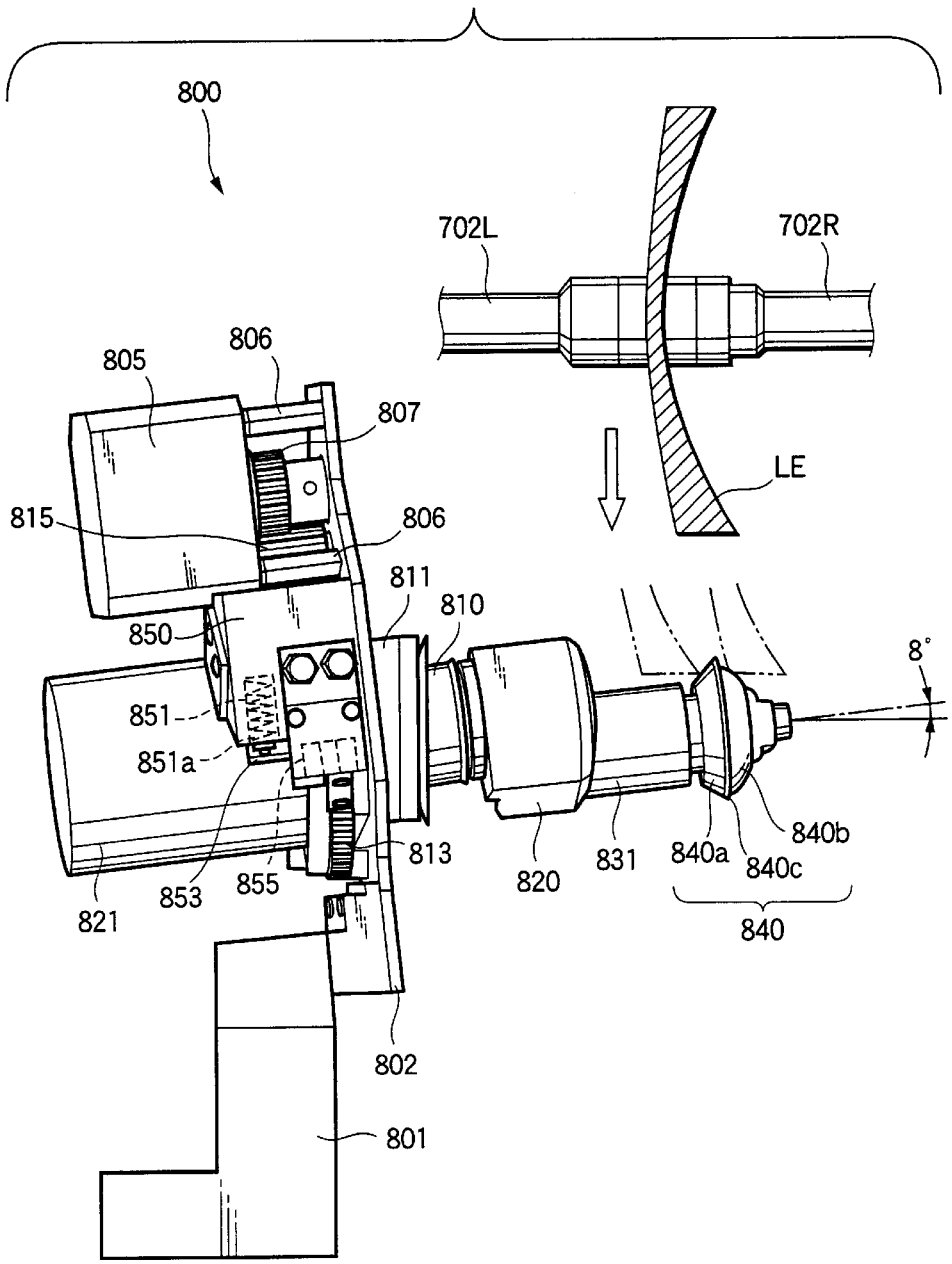
FIG. 10 is a front elevational view of a chamfering and grooving mechanism section.
Figure 11:
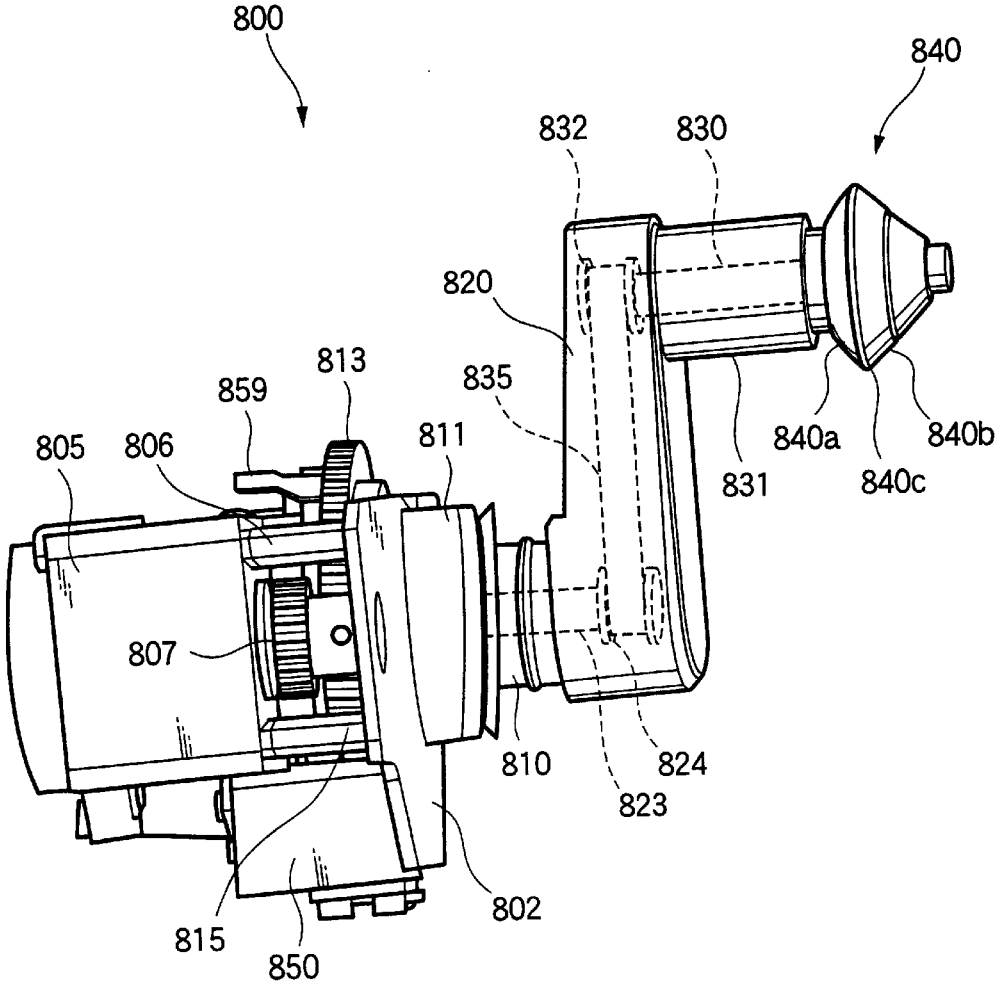
FIG. 11 is a top plan view of the chamfering and grooving mechanism section.
Figure 12:
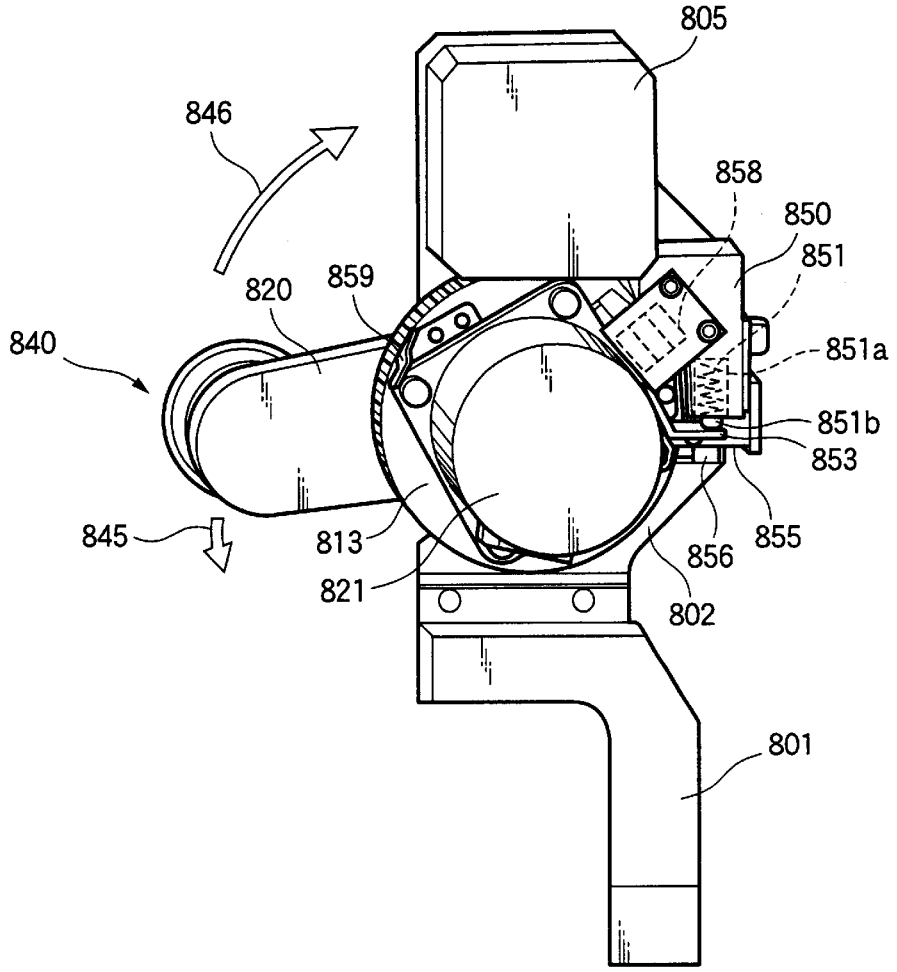
FIG. 12 is a left side elevational view of the chamfering and grooving mechanism section.

Referring to FIGS. 10 to 12, a description will be given of the construction of the chamfering and grooving mechanism section 800. FIG. 10 is a front elevational view of the chamfering and grooving mechanism section 800; FIG. 11 is a top view; and FIG. 12 is a left side elevational view.

A fixed plate 802 for attaching the various members is fixed to a supporting block 801 fixed to the base 10. A pulse motor 805 for rotating an arm 820 (which will be described later) to move an abrasive wheel section 840 to a processing position and a retreated position is fixed on an upper left-hand side of the fixed plate 802 by four column spacers 806. A holding member 811 for rotatably holding an arm rotating member 810 is attached to a central portion of the fixed plate 802, and a large gear 813 is secured to the arm rotating member 810 extending to the left-hand side of the fixed plate 802. A gear 807 is attached to a rotating shaft of the motor 805, and the rotation of the gear 807 by the motor 805 is transmitted to the large gear 813 through an idler gear 815, thereby rotating the arm 820 attached to the arm rotating member 810.

In addition, an abrasive-wheel rotating motor 821 is secured to a rear (left-hand side in FIG. 10) of the large gear 813, and the motor 821 rotates together with the large gear 813. A rotating shaft of the motor 821 is connected to a shaft 823 which is rotatably held inside the arm rotating member 810, and a pulley 824 is attached to the other end of the shaft 823 extending to the interior of the arm 820. Further, a holding member 831 for rotatably holding an abrasive-wheel rotating shaft 830 is attached to a distal end of the arm 820, and a pulley 832 is attached to a left end (left-hand side in FIG. 11) of the abrasive-wheel rotating shaft 830. The pulley 832 is connected to the pulley 824 by a belt 835, so that the rotation of the motor 821 is transmitted to the abrasive-wheel rotating shaft 830.

The abrasive wheel section 840 is mounted on a right end of the abrasive-wheel rotating shaft 830. The abrasive wheel section 840 is so constructed that a chamfering abrasive wheel 840*a* for a lens rear surface, a chamfering abrasive wheel 840*b* for a lens front surface, and a grooving abrasive wheel 840*c* provided between the two chamfering abrasive wheels 840*a* and 840*b* are integrally formed. The diameter of the grooving abrasive wheel 840*c* is about 30 mm, and the chamfering abrasive wheels 840*a* and 840*b* on both sides have processing slanting surfaces such that their diameters become gradually smaller toward their outward sides with the grooving abrasive wheel 840*c* as the center. (The diameter of the grooving abrasive wheel 840*c* is larger than the outmost diameter of each of the chamfering abrasive wheels 840*a* and 840*b*.)

It should be noted that the abrasive-wheel rotating shaft 830 is disposed in such a manner as to be inclined about 8 degrees with respect to the axial direction of the chuck shafts 702L and 702R, so that the groove can be easily formed along the lens curve by the grooving abrasive wheel 840*c*. Additionally, the slanting surface of the chamfering abrasive wheel 840*a* and the slanting surface of the chamfering abrasive wheel 840*b* are so designed that the chamfering angles for the edge corners of the lens LE chucked by the chuck shafts 702L and 702R are respectively set to 55 degrees and 40 degrees.

A block 850 is attached to this side on the left-hand side (this side on the left-hand side in FIG. 10) of the fixed plate 802, and a ball plunger 851 having a spring 851*a* is provided inside the block 850. Further, a limiting plate 853 which is brought into contact with a ball 851*b* of the ball plunger 851 is fixed to the large gear 813. At the time of starting the grooving or chamfering, the arm 820 is rotated together with the large gear 813 by the rotation of the motor 805, so that the abrasive wheel section 840 is placed at the processing position shown in FIG. 12. At this time, the limiting plate 853 is brought to a position for abutment against the ball 851*b*.

A sensor 855 for detecting the origin of the processing position is fixed below the block 850. As the sensor 855 detects the light-shielded state of a sensor plate 856 attached to the large gear 813 so as to detect the origin of the processing position of the abrasive wheel section 840, i.e., the position where the limiting plate 853 abuts against the ball 851*b* without application of the urging force due to the ball plunger 851. This information on the origin of the processing position is used during calibration for defining the distance between the abrasive wheel section 840 and the chuck shafts 702R and 702L.

Further, a sensor 858 for detecting the retreated position is fixed on an upper side of the block 850. As the sensor 858 detects a sensor plate 859 attached to the large gear 813, the sensor 858 detects the retreated position of the abrasive wheel section 840 which is rotated together with the arm 820 in the direction of arrow 846. The retreated position of the abrasive wheel section 840 is set at a position offset rightwardly from a vertical direction in FIG. 12.

Figure 13:
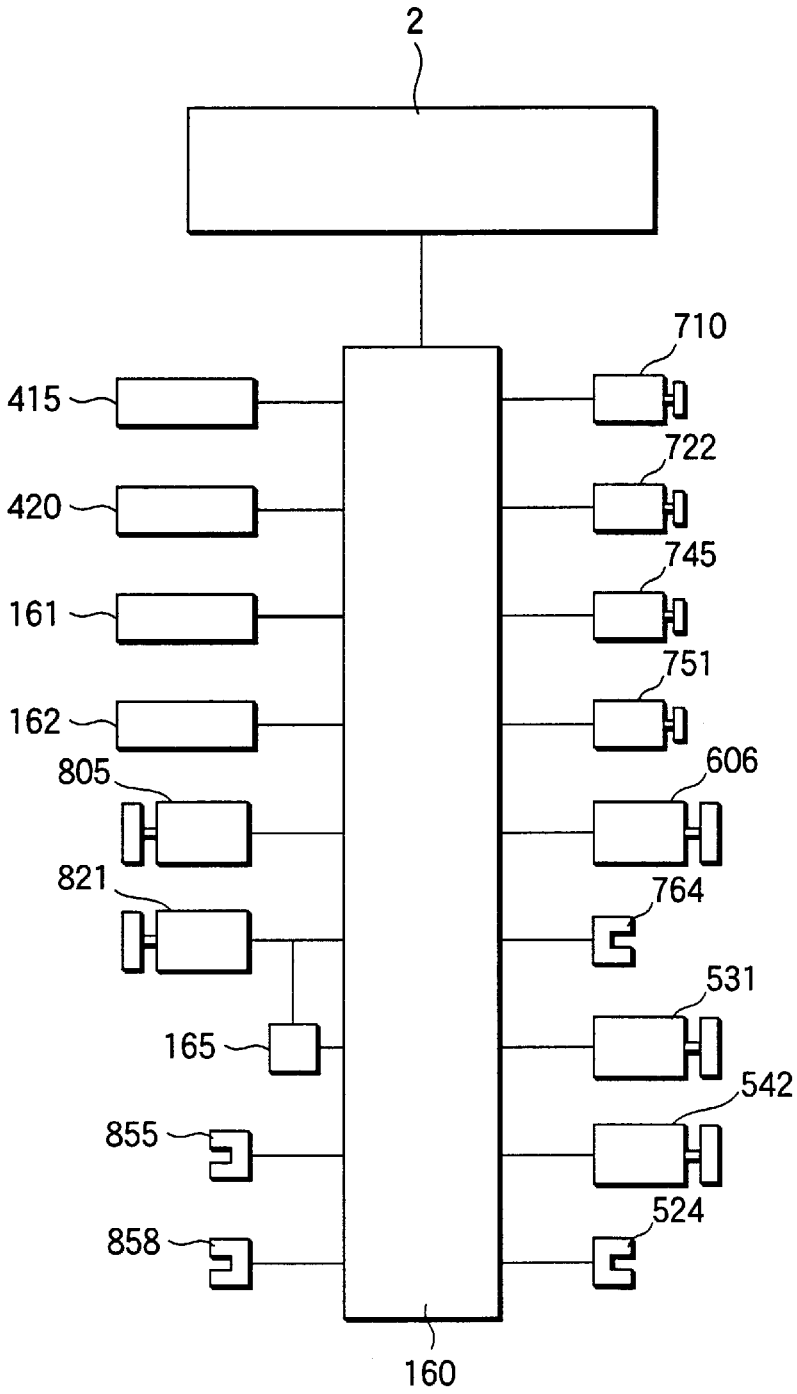
FIG. 13 is a block diagram of a control system of the apparatus.

Next, referring to the control block diagram shown in FIG. 13, a description will be given of the operation of the apparatus having the above-described construction. Here, a description will be given of the case in which grooving processing and chamfering processing are performed.

The shape of an eyeglass frame (or template) for fitting the lens LE is measured by the frame-shape measuring device 2, and the measured target lens shape data is inputted to a data memory 161 by pressing a switch 421. The target lens shape based on the target lens shape data is graphically displayed on the display 415, under which condition the processing conditions can be inputted. By operating switches on the switch panel section 410, the operator inputs necessary layout data such as the PD of the wearer, the height of the optical center, and the like. Further, the operator inputs the material of the lens LE to be processed and the processing mode. In the case where grooving processing is to be effected, the mode for grooving processing is selected by a switch 423 for processing-mode selection. In the case where chamfering is to be effected, a switch 425 is operated to select the chamfering mode. Although the size of chamfering (the chamfering amount) for each of the lens front surface side and the lens rear surface side is stored in a memory 162 as a set value, in the case where the set value of the chamfering amount is to be changed, a menu screen can be opened by switch operation to the switch panel section 410 to change the contents preliminarily set.

Upon completion of the necessary entry, the lens LE is chucked by the chuck shaft 702L and the chuck shaft 702R. In the case where the half-eye lens is to be processed, the cup holder 750*b* and the lens retainer 751*b* are preliminarily attached to chuck shafts 702L and 702R, respectively. Further, the cup 760*b* attached to the lens LE is mounted to the cup holder 750*b*, and then the lens LE chucked.

After the lens LE is completely chucked, the start switch 424 is pressed to operate the apparatus. On the basis of the inputted target lens shape data and layout data, a main control unit 160 obtains radius vector information ($r\delta n$, $r\theta n$) ($n=1, 2, \ldots, N$) with the processing center as the center, determines processing correction information from positional information on a contact point where the radius vector abuts against the abrasive wheel surface (refer to Re. Pat. No. 35,898 (U.S. Pat. No. 5,347,762)), and stores it in the memory 161.

Subsequently, the main control unit 160 executes the lens shape measurement by using the lens-shape measuring section 500 in accordance with a processing sequence program. The main control unit 160 drives the motor 531 to rotate the shaft 511, causing the feeler arms 514 and 516 to be positioned to the measuring position from the retreated position. On the basis of the radius vector data ($r\sigma n$, $r\theta n$), the main control unit 160 vertically moves the carriage 701 so as to change the distance between the axis of the chuck shafts (702L, 702R) and the axis Lb connecting the feeler 515 and the feeler 517, and causes the chucked lens LE to be located between the feeler 515 and the feeler 517, as shown in FIG. 5. Subsequently, the carriage 701 is moved by a predetermined amount toward the feeler 517 side by driving the motor 745 so as to cause the feeler 517 to abut against the front-side refracting surface of the lens LE. The initial measuring position of the lens LE on the feeler 517 side is at a substantially intermediate position in the leftward moving range of the sliding base 510, and a force is constantly applied to the feeler 517 by the spring 555 such that the feeler 517 abuts against the front-side refracting surface of the lens LE.

In the state in which the feeler 517 abuts against the front-side refracting surface, the lens LE is rotated by the motor 722, and the carriage 701 is vertically moved by driving the motor 751 on the basis of the radius vector information, i.e. the processing shape data. In conjunction with such movement and rotation of the lens LE, the feeler 517 moves in the left-and-right direction along the shape of the lens front surface. The amount of this movement is detected by the encoder 542, and the shape of the front-side refracting surface of the lens LE (the path of the front-side edge position) after finishing processing is measured.

In the case where the rear-side refracting surface of the lens LE is to be measured, the main control unit 160 rightwardly moves the carriage 701, and causes the feeler 515 to abut against the rear-side refracting surface of the lens LE to change over the measuring surface. The initial measuring position of rear-side measurement is similarly at a substantially intermediate position in the rightward moving range of the sliding base 510, and a force is constantly applied to the feeler 515 such that the feeler 515 abuts against the rear-side refracting surface of the lens LE. Subsequently, while causing the lens LE to undergo one revolution, the shape of the rear-side refracting surface (the path of the rear-side edge position) of the lens LE after the finishing processing is measured from the amount of movement of the feeler 515 in the same way as in the measurement of the front-side refracting surface. When the shape of the front-side refracting surface and the shape of the rear-side refracting surface of the lens LE can be obtained, edge thickness information can be obtained from the two items of the information. After completion of the lens shape measurement, the main control unit 160 drives the motor 531 to retreat the feeler arms 514 and 516.

The measurement of edge position for each of the front surface side and the rear surface side of the lens LE is executed at different positions with respect to the radius vector (i.e. the edge position at the outermost diameter, and the edge position inner than the former edge position), and the information on these edge positions is used for calculating the chamfering amount.

Upon completion of the measurement of the lens shape, the main control unit 160 executes the processing of the lens LE in accordance with the input data of the processing conditions. In a case where the lens LE is a plastic, the main control unit 160 moves the carriage 701 by means of the motor 745 so that the lens LE is brought over the rough abrasive wheel 602*b*, and vertically moves the carriage 701 on the basis of the processing correction information to perform rough processing. Next, the lens LE is moved to the planar portion of the finishing abrasive wheel 602*c*, and the carriage 701 is vertically moved in the similar fashion to perform finish processing.

Upon completion of finish processing, the operation then proceeds to grooving processing by the chamfering and grooving mechanism section 800. After raising the carriage 701, the main control unit 160 rotates the motor 805 a predetermined number of pulses so that the abrasive wheel section 840 placed at the retreated position comes to the processing position. Subsequently, as the carriage 701 is moved vertically and in the axial direction of the chuck shaft, the lens LE is positioned on the grooving abrasive wheel 840*c* which is rotated by the motor 821, and processing is effected by controlling the movement of the carriage 701 on the basis of grooving processing data.

The grooving processing data is determined in advance by the main control unit 160 from the radius vector information and the measured results of the lens shape. The data for vertically moving the carriage 701 is obtained by first determining the distance between the abrasive wheel 840*c* and the lens chuck shaft relative to the angle of lens rotation from the estimated radius vector information (rσn, rθn) and the diameter of the abrasive wheel 840*c* in the same way as for the group of abrasive wheels 602, and then by incorporating information on the groove depth into it. In addition, as for the data on the groove position in the axial direction of the chuck shaft, since the edge thickness can be known from the shape of the front-side refracting surface and the shape of the rear-side refracting surface based on the measured data on the lens shape, the data on the groove position in the axial direction of the chuck shaft can be determined on the basis of this edge thickness in a procedure similar to that for determining the beveling position. For example, in addition to a method in which the lens edge thickness is divided at a certain ratio, it is possible to adopt various methods including one in which the groove position is offset by a fixed amount from the edge position of the lens front surface toward the rear surface, and is made to extend along the front surface curve.

The grooving processing is effected while the lens LE is being caused to abut against the abrasive wheel 840*c* by the vertical movement of the carriage 701. During the processing, the abrasive wheel 840*c* escapes from the origin of the processing position in the direction of arrow 845 in FIG. 12, but since a load is being applied to the abrasive wheel section 840 by the ball plunger 851, the lens LE is gradually ground. Whether or not the grooving processing has been effected down to a predetermined depth is monitored by the sensor 858, and the lens rotation is carried out until the completion of the processing of the entire periphery is detected.

Upon completion of the grooving processing, the main control unit 160 effects chamfering by controlling the movement of the carriage 701 on the basis of the chamfering data.

A description will be given of the calculation of the processing data at the time of chamfering, i.e. the calculation of the chamfering processing path. When chamfering is provided for the rear surface side and the front surface side of the lens LE, the respective processing data are calculated. A description will be given herein by citing as an example the case of the rear surface side of the lens LE.

A maximum value of L is determined by substituting the radius vector information (rσn, rθn) (n=1, 2, . . . , N) into the formula given below. R represents the radius of the chamfering abrasive wheel 840*a* at the position where an edge of the rear surface of the lens abuts (e.g., an intermediate position of the abrasive wheel surface), and L represents the distance between the center of rotation of the abrasive wheel and the processing center of the lens LE.

$$L = r\sigma n \cdot \cos r\theta n + [R^2 - (r\sigma n \cdot \sin r\theta n)^2]^{1/2} \quad (n=1, 2, 3, \ldots, N) \qquad \text{[Formula 1]}$$

Next, the radius vector information (rσn, rθn) is rotated by a very small arbitrary unit angle about the processing center, and a maximum value of L at that time is determined in the same way as described above. This rotational angle is set as ξi (i=1, 2, . . . , N). By performing this calculation over the entire periphery, chamfering correction information in the radius vector direction can be obtained as (ξi, Li, Θi) in which a maximum value of L at the respective ξi is set as Li, and rθn at that time is set as Θi.

Figure 15:
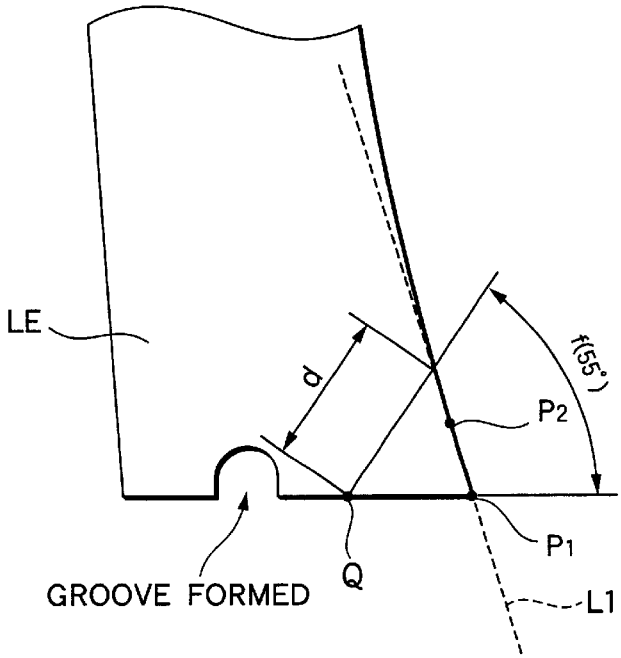
FIG. 15 is an explanatory diagram as to how to obtain a processing locus of chamfering process.

The processing information in the axial direction of the lens chuck shaft for chamfering the rear surface side of the lens LE is obtained, as shown in FIG. 15, such that the path of a processing point Q is obtained based on an inclination angle of the lens rear surface (i.e. an inclination angle of a linear line L1 connecting points P1 and P2), which is obtained from the edge position information on the two points P1 and P1 obtained through the lens shape measurement, a chamfering amount d and an inclination angle f of the chamfering abrasive wheel. The method of obtaining the chamfering processing path is basically the same as that disclosed in commonly assigned U.S. Pat. No. 6,062,947, and thus as to the details of this method, reference should be made on this patent.

During chamfering processing, the main control unit 160 rotates the lens LE while controlling the vertical movement and lateral (right-and-left) movement of the carriage 701 based on the chamfering processing data, so that the lens LE is brought into contact with the abrasive wheel 840*a* of the abrasive wheel section 840 disposed at the processing position, thereby executing the chamfering processing.

Figure 16:
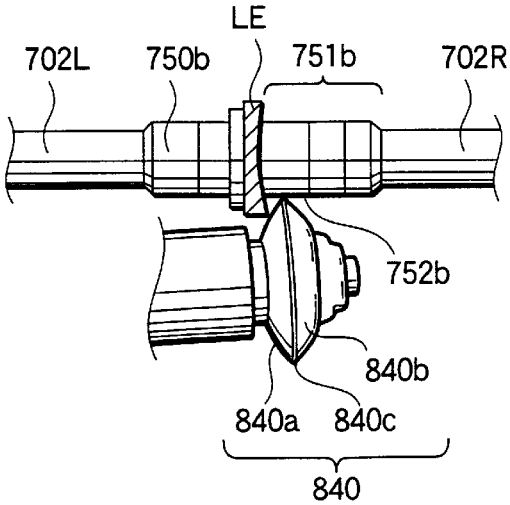
FIG. 16 is a diagram showing an example in which a grooving abrasive wheel interferes with a lens retainer.

Here, in the case where the lens LE is a half-eye lens, the abrasive wheel 840*c* abuts against the rubber member 752*c* of the lens retainer 751*b* attached to the chuck shaft 702R side when a portion of the lens LE, not having sufficient processing diameter, is processed (see FIG. 16). Since the abrasive wheel 840*c* is a diamond abrasive wheel, the abrasive wheel 840*c* can grind the lens retaining member such as the rubber member 752*b* and the like. If the abrasive wheel 840*c* contacts and grounds the rubber member 752*b*, then a rotational load larger than that in a normal processing is applied to the motor 821 rotating the abrasive wheel section 840. An electric current detecting section 165 is connected to the motor 821, and the output from the detecting section 165 is inputted to the control unit 160. The control unit 160 always monitors the load electric current of the motor 821 through the electric current detecting section 165, and if the load electric current of the motor 821 exceeds a predetermined reference value I1 higher than that in a normal chamfering processing (for example, the load electric current in the normal chamfering processing is about 2.0 A, whereas the predetermined reference value I1 used to judge the application of the large rotational load is 2.5 A), the judgment is made that the processing load is applied to the abrasive wheel section 840, upon which the carriage 701 is upwardly moved through drive control of the motor 701 so that the lens LE escapes from the abrasive wheel section 840. The escape distance in this operation is set to about 0.5 mm, and the time for escape is set to be 3.6 degrees (1/100 rotation) in terms of rotation angle of the lens LE. The rotation angle of the lens LE is controlled based on the drive pulses of the motor 722.

After the lens LE is rotated 3.6 degrees, the control unit 160 downwardly moves the carriage 701 again in accordance with the chamfering processing data, and repeats these operations until the load electric current of the motor 821 falls within the reference value I1. With this processing, the lens having a small processing diameter, such as the half-eye lens, can be subjected to the chamfering processing as much as possible. That is, a range that the processing is applicable can be enlarged.

Even in the case of a lens having such a sufficient processing diameter that the chamfering can be applied to the entire periphery of the lens, the control unit 160 monitors the load electric current of the motor 821, and if the predetermined reference value I1 is exceeded, the carriage 701 is moved in such a direction as to escape from the abrasive wheel section 840 during the predetermined lens rotation angle, and the chamfering processing is carried out in the state that the load electric current is lower than the reference value I1, similarly to the former case. The movement of the carriage 701 is controlled in accordance with the chamfering processing data, and if it is confirmed that the load electric current of the motor 821 over the entire periphery of the lens LE is lower than a reference value I2 set to be lower than the reference value I1 (the reference value I2 may be set to be equal to the reference value I1), the chamfering processing is completed. The processing is completed when lens LE is rotated at three or four times, even if the chamfering amount is set to be 1 mm. By way of the monitoring of the rotation state of the abrasive wheel section 840 and the controlling of the movement of the carriage 701 by the control unit 160, the efficient processing can be realized using the performance of the abrasive wheel effectively while balancing the rotational load on the motor 821 with the processing amount appropriately.

On the other hand, in the case of the half-eye lens small in processing diameter, the interference of the abrasive wheel 840*c* with the lens retainer 751*b* side at a portion of the lens LE as mentioned above may cause the load electric current of the motor 821 not to be lower than the reference value I2 (or the reference value I1) over the entire lens periphery even if the lens LE is rotated several times. To cope with this, the control unit 160 completes the chamfering processing if the lens LE is rotated, for example, five times. The number of rotation of the lens LE for judgment of the processing completion can be determined in relation to a maximum number of rotation of the lens LE by which the entire periphery of the lens LE can be chamfered. The number of rotation of the lens LE can be known based on the drive pulses of the motor 722.

In addition, as to the method of detecting the processing load on the chamfering abrasive wheel during chamfering processing, not only a method in which an electric current of an abrasive wheel rotating motor is directly detected as mentioned above, but also a method in which the load is detected based on variation in electric current of a motor rotating the lens LE, can be employed. Alternatively, the rotation state of the abrasive wheel side can be detected optically (see U.S. Pat. No. 6,123,604).

The description has been given of the case that the chamfering is effected on the lens rear surface side. This is also applied to the case of the lens front surface, such that the load of the motor 821 when the abrasive wheel 840*c* abuts against the cup holder 750*b* and the like is detected, and the carriage 701 is similarly controlled to be moved in the direction away from the abrasive wheel section 840. Further, such an arrangement may be employed that the abrasive wheel rotation shaft 830 side is relatively moved. Moreover, the component, i.e. the carriage 701 or the abrasive wheel rotation shaft 830 side, may be moved in the direction of the rotation axis.

The apparatus of this embodiment is arranged such that the grooving abrasive wheel 840*c* is coaxially provided with respect to the chamfering abrasive wheels 840*a* and 840*b*. However, even in the case where the abrasive wheel 840*c* is not provided, the outmost diameter portion of the abrasive wheel 840*a*, 840*b* may abut against the cup holder 750*b*, the lens retainer 751*b* or the like if the processing is carried out on a lens portion not having the sufficient processing diameter. Accordingly, the similar control for chamfering processing can be applied also to this case. Further, the similar control can be applied to a type in which the chamfering abrasive wheel is provided coaxially with respect to the rough abrasive wheel 602*a* and the like. The chamfering abrasive wheel 840*a*, 840*b* is constructed also as a diamond abrasive wheel, and thus is not substantially influenced by the lens holding member. Since the lens holding member such as the lens retainer 751*b* and the like is of a supply replaceable with a new one, and therefore the damaged lens holding member can be easily replaced with a new one.

As described above, according to the present invention, a processing diameter of a lens to be chamfered can be made as small as possible, thereby enlarging a range in which the chamfering processing can be applied. Further, the lens processing can be executed efficiently.

What is claimed is:

1. An eyeglass lens processing apparatus for processing a periphery of an eyeglass lens, comprising:

a lens rotating shaft which holds an eyeglass lens to be processed through a cup holder and a lens retainer and rotates the lens;

an abrasive wheel rotating shaft;

a chamfering abrasive wheel which is attached to and is rotated by the abrasive wheel rotating shaft and which chamfers the lens;

a moving unit which applies a processing pressure between the lens and the chamfering abrasive wheel by relatively moving the lens and the chamfering abrasive wheel one from another;

a detecting unit which detects a processing load to at least one of the lens and the chamfering abrasive wheel; and a control unit which issues a control signal for reducing the processing load lower than a predetermined first level if the detected processing load is higher than the first level and for continuing the chamfering, and which issues a control signal for ending the chamfering if the detected processing load over the entire periphery of the lens is lower than a predetermined second levels, wherein the first level is a level representing a processing load which is generated when a part of the cup holder or the lens retainer is processed.

2. The eyeglass lens processing apparatus according to claim 1, wherein the control unit issues a control signal for ending the chamfering if a predetermined time period is elapsed or the lens is rotated predetermined number of times even in a case where the detected processing load over the entire periphery of the lens is not lower than the predetermined second level.

3. The eyeglass lens processing apparatus according to claim 1, wherein the lens rotating shaft includes a first shaft having a cup holder to which a cup attached to the lens is to be attached, and a second shaft having a lens retainer to which a rubber member for abutting against the lens is fixed, and the first and second shafts are relatively moved one from another in a direction of a rotational axis thereof to clamp the lens therebetween.

4. The eyeglass lens processing apparatus according to claim 1, further comprising:

a first rotating unit having a first motor, which rotates the lens rotating shaft;

a second rotating unit having a second motor, which rotates the abrasive wheel rotating shaft; and wherein the detecting unit detects the processing load based on a load electric current of at least one of the first and second motors.

* * * * *